US006702726B2

(12) United States Patent
Lin

(10) Patent No.: US 6,702,726 B2
(45) Date of Patent: Mar. 9, 2004

(54) COMPLIANT BODY-PRESSING EXERCISER

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 245 days.

(21) Appl. No.: 10/037,937

(22) Filed: Jan. 3, 2002

(65) Prior Publication Data

US 2003/0125174 A1 Jul. 3, 2003

(51) Int. Cl.[7] ..... A63B 26/00
(52) U.S. Cl. ..... 482/148; 482/140; 446/220
(58) Field of Search ..... 482/148, 140, 482/132, 142, 121–130; 446/220

(56) References Cited

U.S. PATENT DOCUMENTS 2,797,685 A * 7/1957 Packwood ..... 128/57
5,833,587 A * 11/1998 Strong et al. ..... 482/123
6,309,331 B1 * 10/2001 Raymond ..... 482/148
6,375,601 B1 * 4/2002 Johnson ..... 482/142

* cited by examiner

*Primary Examiner*—Nicholas D. Lucchesi
*Assistant Examiner*—L Amerson
(74) *Attorney, Agent, or Firm*—Ladas & Parry

(57) ABSTRACT

A compliant body-pressing exerciser is adapted to be detachably coupled to a seat frame, and includes a bowl-shaped lower member and a dome-shaped upper member formed respectively with upper and lower surrounding edge portions that engage each other and adapted to contact the ground and compliantly press against a user's body. A height of the upper member is larger than that of the lower member. A shortest one of radial distances measured from a central point to the lower surrounding edge portion is not less than the height of the upper member so as to lower the gravity center of the exerciser.

11 Claims, 14 Drawing Sheets

COMPLIANT BODY-PRESSING EXERCISER

BACKGROUND OF THE INVENTION

1. Field of the Invention

This invention relates to an exercise apparatus, more particularly to a compliant body-pressing exerciser which is rollable and which is detachably coupled to a seat frame for performing different exercising modes.

2. Description of the Related Art

A conventional resilient ball for exercise is made of a deformable material to permit a user to lie on his back to exercise his upper body part, or to press his abdominal part against the ball while lifting his legs from the ground and placing his hands on the ground for exercising his arms. Another conventional balance exerciser has a spherical resilient member which is secured on a seat. The user can lie or stand on the spherical resilient member to perform abdominal part and balance exercises, respectively. It is desirable to provide a compliant body-pressing exerciser which is rollable on the ground and which can be retained from rolling to perform a wide variety of exercising modes.

SUMMARY OF THE INVENTION

The object of the present invention is to provide a compliant body-pressing exerciser suitable for use when performing a wide variety of exercising modes.

According to this invention, the compliant body-pressing exerciser includes a bowl-shaped lower member and a dome-shaped upper member. The bowl-shaped lower member is adapted to contact the ground and includes an upper surrounding edge portion, and a lower rounded wall which extends downwardly and convergently from the upper surrounding edge portion and which terminates at a lowermost spot adapted to contact the ground when the exerciser is not in use. The dome-shaped upper member is adapted to compliantly press against a user's body, and includes a lower surrounding edge portion which engages the upper surrounding edge portion and which is associated with the upper surrounding edge portion to form a reference plane that is parallel to the ground, and an upper rounded wall which extends upwardly and convergently from the lower surrounding edge portion and which terminates at an apical spot. The apical spot cooperates with the lowermost spot to define a central line that is normal to and that intersects the reference plane at a central point. The bowl-shaped lower member and the dome-shaped upper member are configured such that a first height which is calculated from the apical spot to the central point is larger than a second height which is calculated from the lowermost spot to the central point, and such that a shortest one of first radial distances measured from the central point to the lower surrounding edge portion is not less than the first height.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
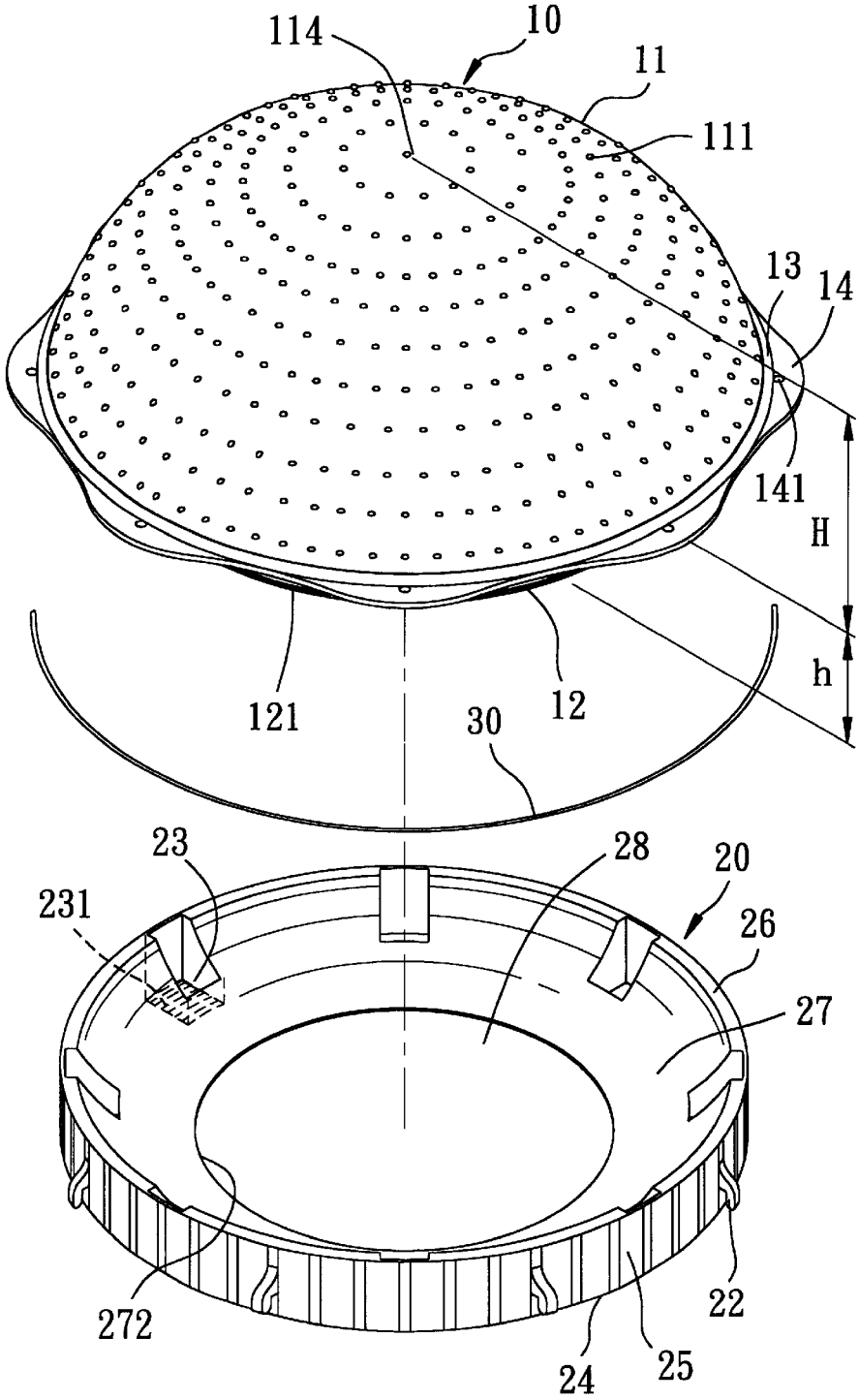
FIG. 1 is an exploded perspective view of a preferred embodiment of a compliant body-pressing exerciser assembly according to this invention.
Figure 2:
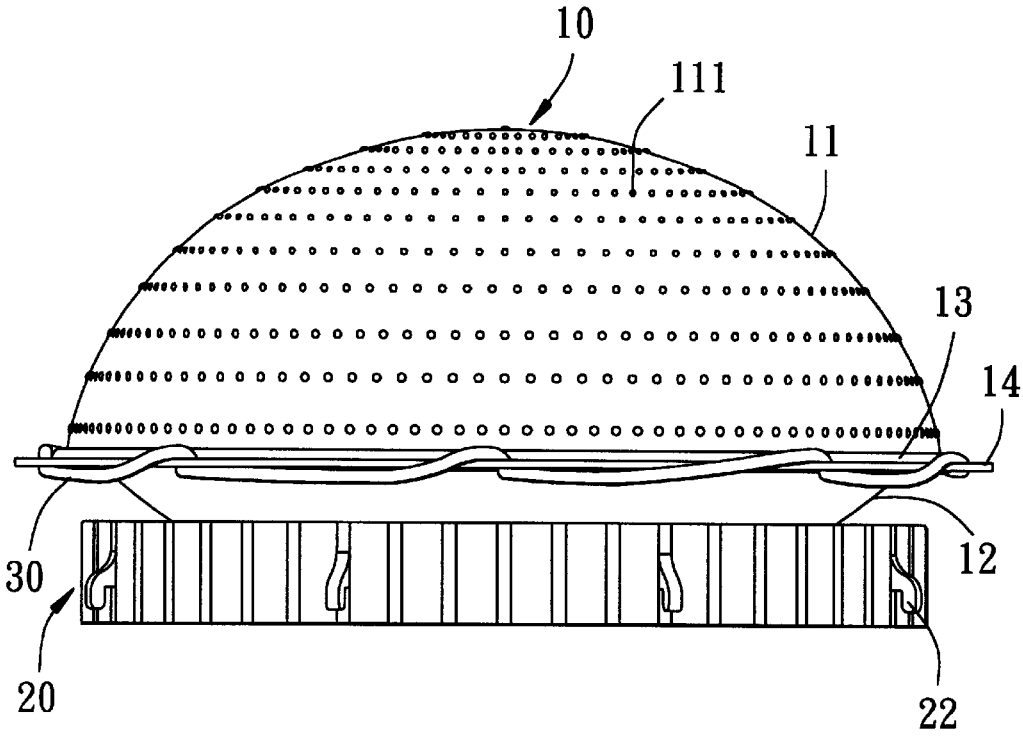
FIG. 2 is a side view of the preferred embodiment.
Figure 3:
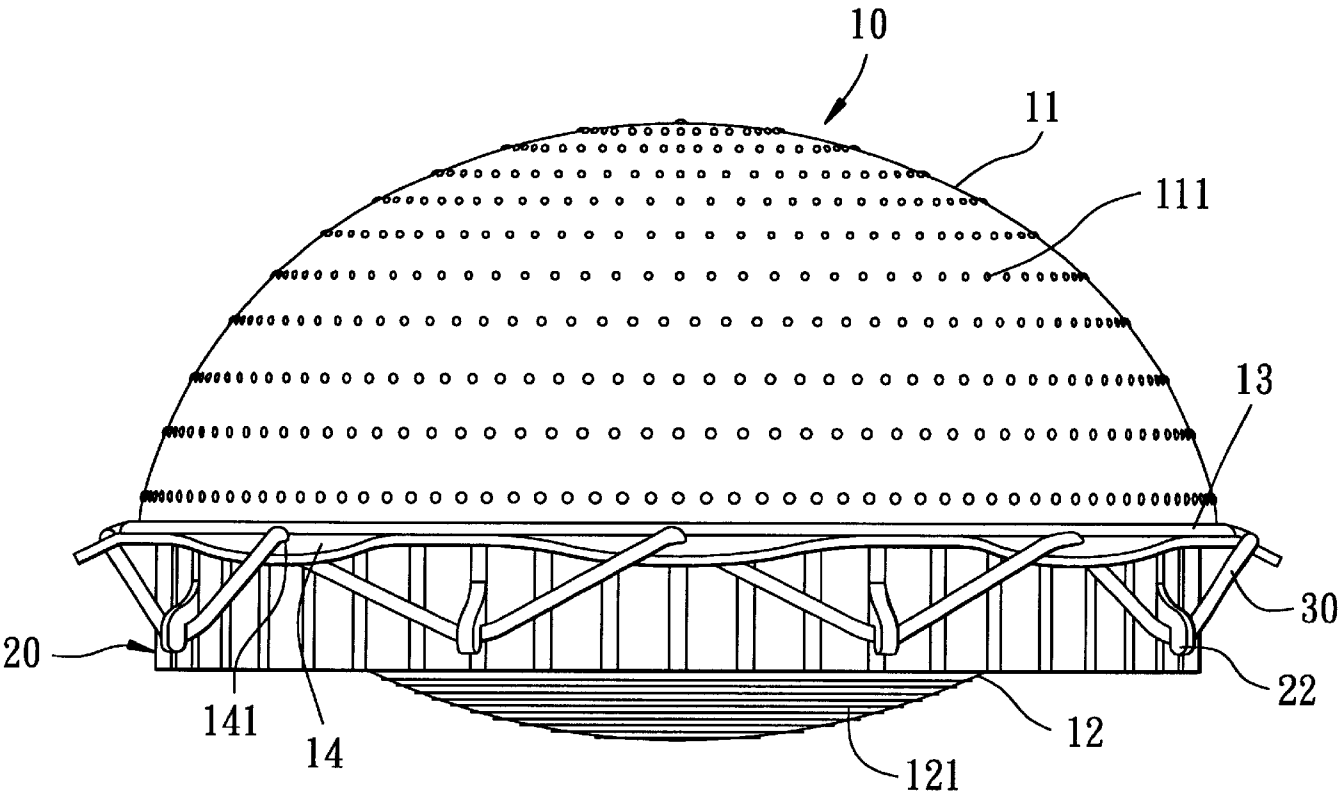
FIG. 3 is a side view of the preferred embodiment to illustrate a compliant body-pressing exerciser when fastened on a seat frame.

Referring to FIG. 1, the first preferred embodiment of the compliant body-pressing exerciser assembly according to the present invention is shown to comprise a compliant body-pressing exerciser 10, a seat frame 20, and a fastening cord 30.

Figure 4:
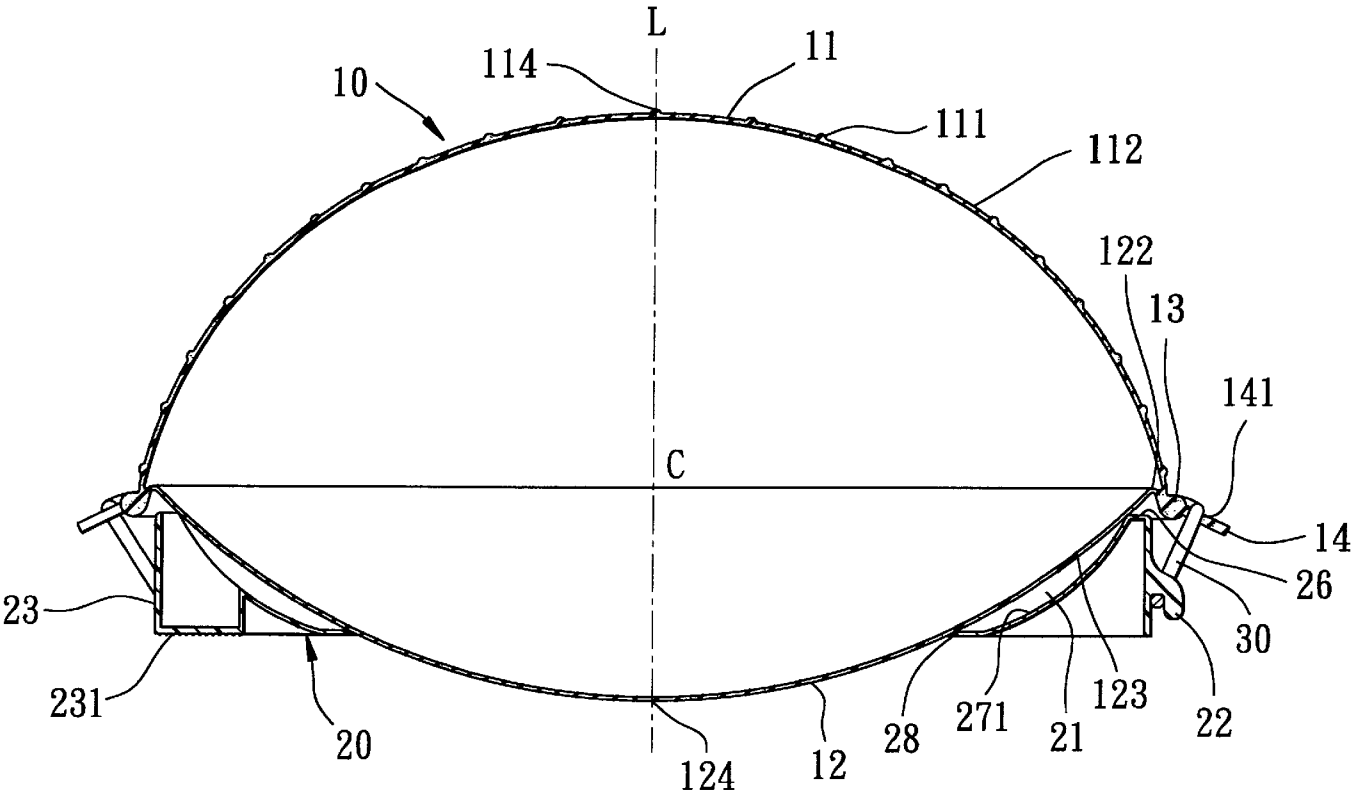
FIG. 4 is a sectional view of the preferred embodiment.

With reference to FIG. 4, the exerciser 10 is made integrally of a deformable material, such as plastic, which may be inflated or filled with water. The exerciser 10 includes a bowl-shaped lower member 12 and a dome-shaped upper member 11. The bowl-shaped lower member 12 is adapted to contact the ground and includes an upper surrounding edge portion 122, and a lower rounded wall 123 which extends downwardly and convergently from the upper surrounding edge portion 122 and which terminates at a lowermost spot 124 that is adapted to contact the ground when the exerciser 10 is not in use. The dome-shaped upper member 11 is adapted to compliantly press against a user's body, and includes a lower surrounding edge portion 13 which is disposed to engage the upper surrounding edge portion 122 and which is associated with the upper surrounding edge portion 122 to form a reference plane that is adapted to be parallel to the ground, and an upper rounded wall 112 which extends upwardly and convergently from the lower surrounding edge portion 13 and which terminates at an apical spot 114. The apical spot 114 cooperates with the lowermost spot 124 to define a central line (L) that is normal to and that intersects the reference plane at a central point (C). The bowl-shaped lower member 12 and the dome-shaped upper member 11 are configured such that a first height (H) which is calculated from the apical spot 114 to the central point (C) is larger than a second height (h) which is calculated from the lowermost spot 124 to the central point (C). In addition, a shortest one of first radial distances measured from the central point (C) to the lower surrounding edge portion 13 is not less than the first height (H). In this embodiment, the second height (h) is not larger than ⅔ of a shortest one of second radial distances measured from the central point (C) to the upper surrounding edge portion 122. Thus, the gravity center of the exerciser 10 is lowered for steady mounting on the seat frame 20.

Moreover, a plurality of protrusions 111 are disposed on and extend outwardly from the upper rounded wall 112 of the dome-shaped upper member 11 for massaging the user's body. A plurality of concentric friction ribs 121 are formed on the lower rounded wall 123 of the bowl-shaped lower member 12 and around the lowermost spot 124 to increase friction thereof with the ground. A plurality of lugs 14 are disposed on and extend radially and outwardly from the juncture of the upper and lower surrounding edge portions 122, 13, and are angularly displaced from one another. Each lug 14 has an eyelet 141 formed therein.

Referring to FIGS. 1 to 4, the seat frame 20 has a bottom wall 24, a surrounding wall 25 which extends upwardly from a periphery of the bottom wall 24 to surround a middle line and to terminate at a surrounding upper peripheral edge portion 26, and an inner concave portion 27 which is disposed to extend from the surrounding upper peripheral edge portion 26 downwardly and toward the middle line so as to form an inner concave surface 271 which confines an accommodation space 21. In this embodiment, the inner concave surface 271 has a surrounding lower peripheral edge portion 272 which surrounds the middle line and which is disposed opposite to the surrounding upper peripheral edge portion 26 to confine an opening 28. As such, the bowl-shaped lower member 12 can be retained in the accommodation space 21 with the juncture of the upper and lower surrounding edge portions 122, 13 disposed on the upper peripheral edge portion 26, and with the friction ribs 121 of the lower rounded wall 123 passing through the opening 28.

Preferably, the inner concave surface 271 has a first curvature which is larger than a second curvature of the lower rounded wall 123 so that when the dome-shaped upper member 11 is pressed, the lower rounded wall 123 is deformed to retract into the accommodation space 21 to contact tightly the inner concave surface 271.

Moreover, the seat frame 20 further includes a plurality of anchoring members 22 disposed on the surrounding wall 25. Thus, the fastening cord 30 can pass through the eyelets 141 in the lugs 14 and fastened to the anchoring members 22 so as to fasten the exerciser 10 on the seat frame 20. Furthermore, a plurality of support leg members 23 are disposed on and extend downwardly from the surrounding wall 25 to support the seat frame 20 on the ground. Each support leg member 23 is provided with friction ribs 231 on a bottom wall thereof.

Figure 5:
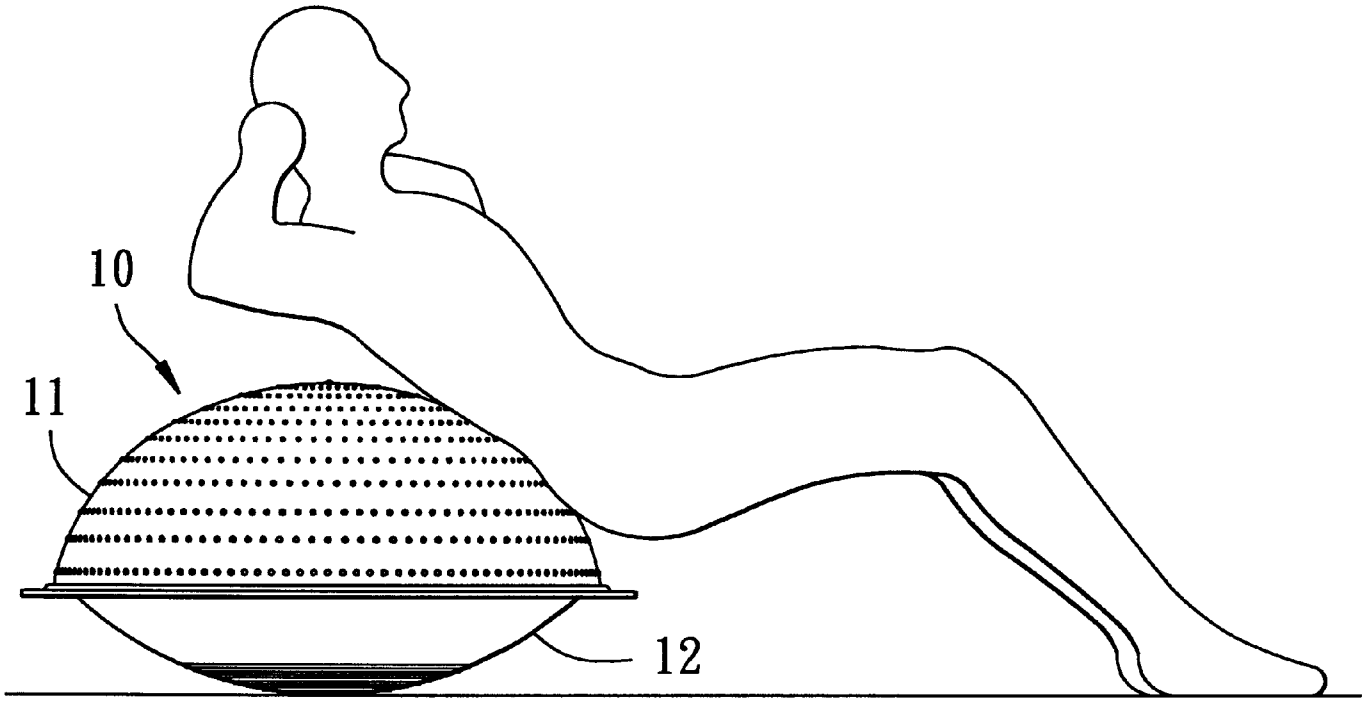
FIGS. 5, 6 and 7 are schematic views illustrating three exercising modes that can be performed using the compliant body-pressing exerciser, respectively.
Figure 6:
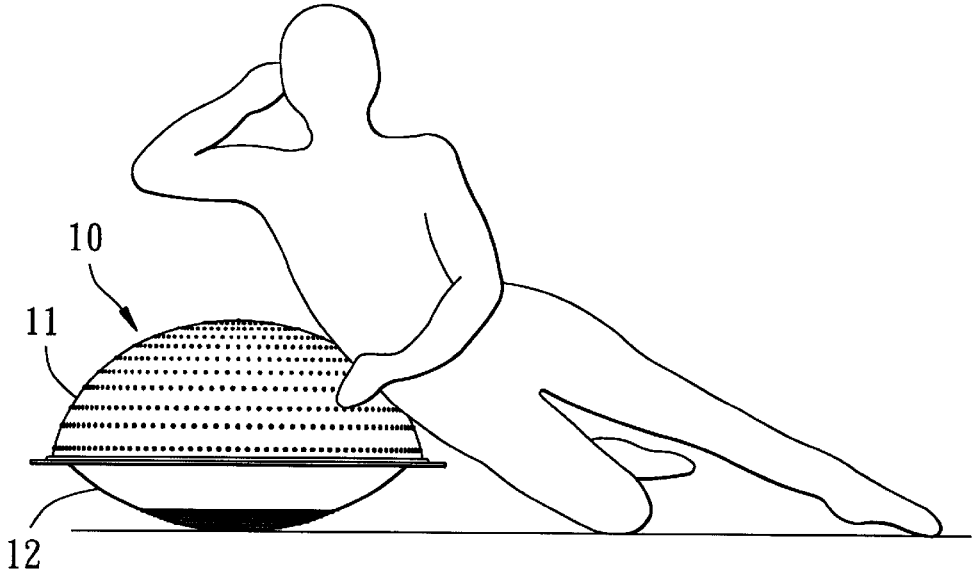
Figure 7:
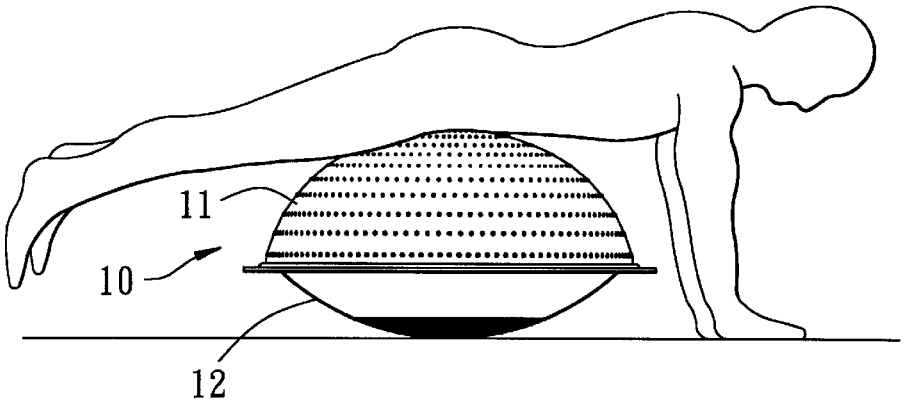

Referring to FIGS. 5 to 7, when only the exerciser 10 is in use, the user can lie on his back on the dome-shaped upper member 11 of the exerciser 10 and bend his upper body part to exercise his abdominal part. The user can also lean against the dome-shaped upper member 11 with his waist part to exercise the side portion of his upper body part, or contact the dome-shaped upper member 11 using his abdominal part, lift his legs from the ground and place his hands on the ground to exercise his arms.

Figure 8:
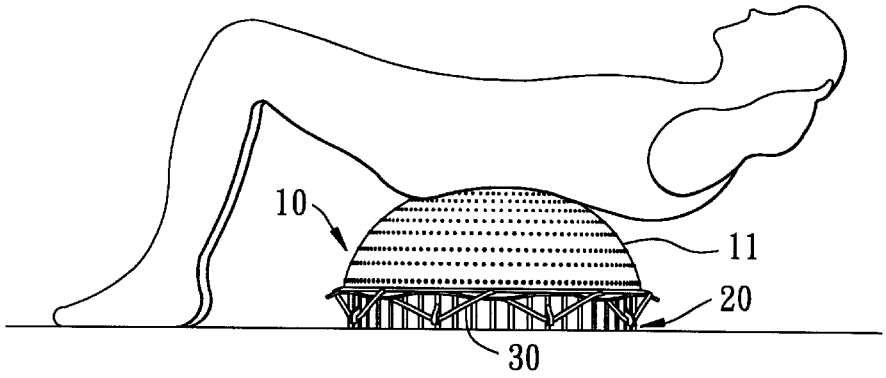
FIGS. 8, 9 and 10 are schematic views illustrating three exercising modes that can be performed using the compliant body-pressing exerciser assembly, respectively.
Figure 9:
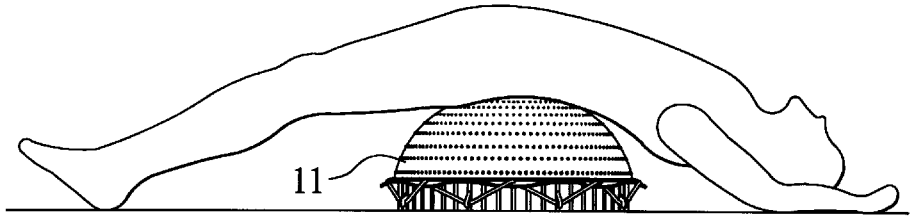
Figure 10:
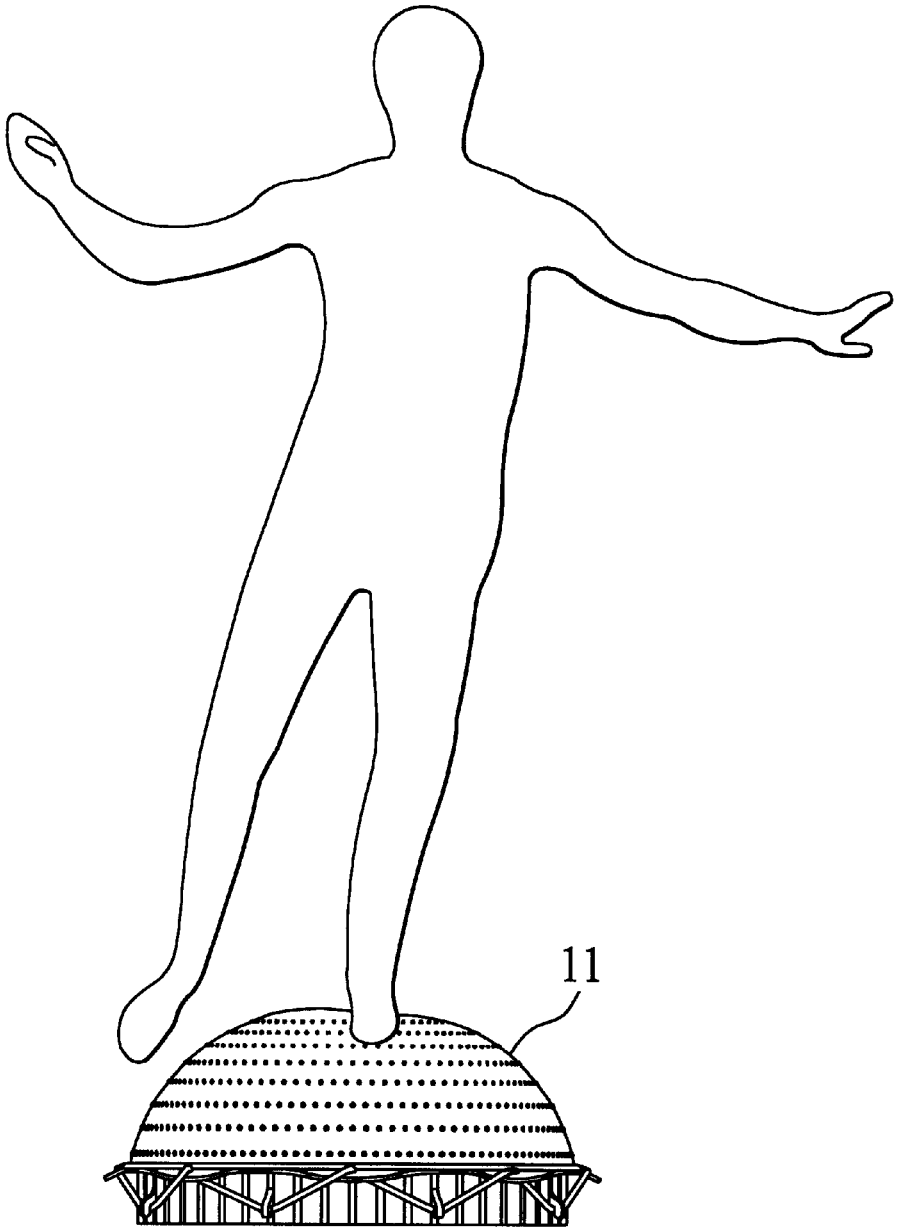

Referring to FIGS. 8 to 10, when the exerciser 10 is retained on the seat frame 20 by means of the fastening cord 30 which engages the eyelets 141 and the anchoring members 22, the user, similar to that shown in FIG. 5, can lie on his back on the dome-shaped upper member 11 to exercise his upper body part or to perform stretching exercise. Also, the user can stand on one leg on the dome-shaped upper member 11 for balance exercise.

As illustrated, when the exerciser 10 is used without the seat frame 20, it is deformable and rollable on the ground so that exercise modes similar to those of a conventional resilient ball can be performed. When the exerciser 10 is used with and is fastened to the seat frame 20, balance exercise similar to that of a conventional balance exerciser can be performed.

Figure 11:
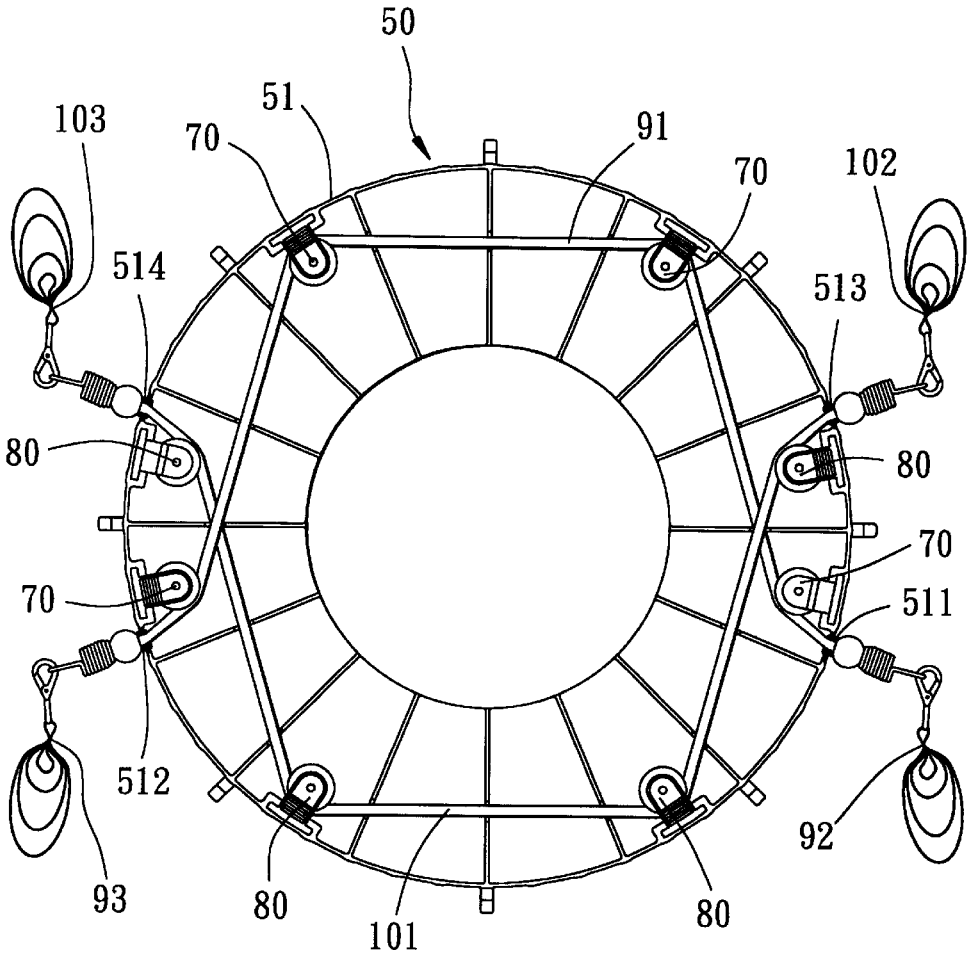
FIG. 11 is a bottom view of another preferred embodiment of the compliant body-pressing exerciser assembly according to this invention.
Figure 12:
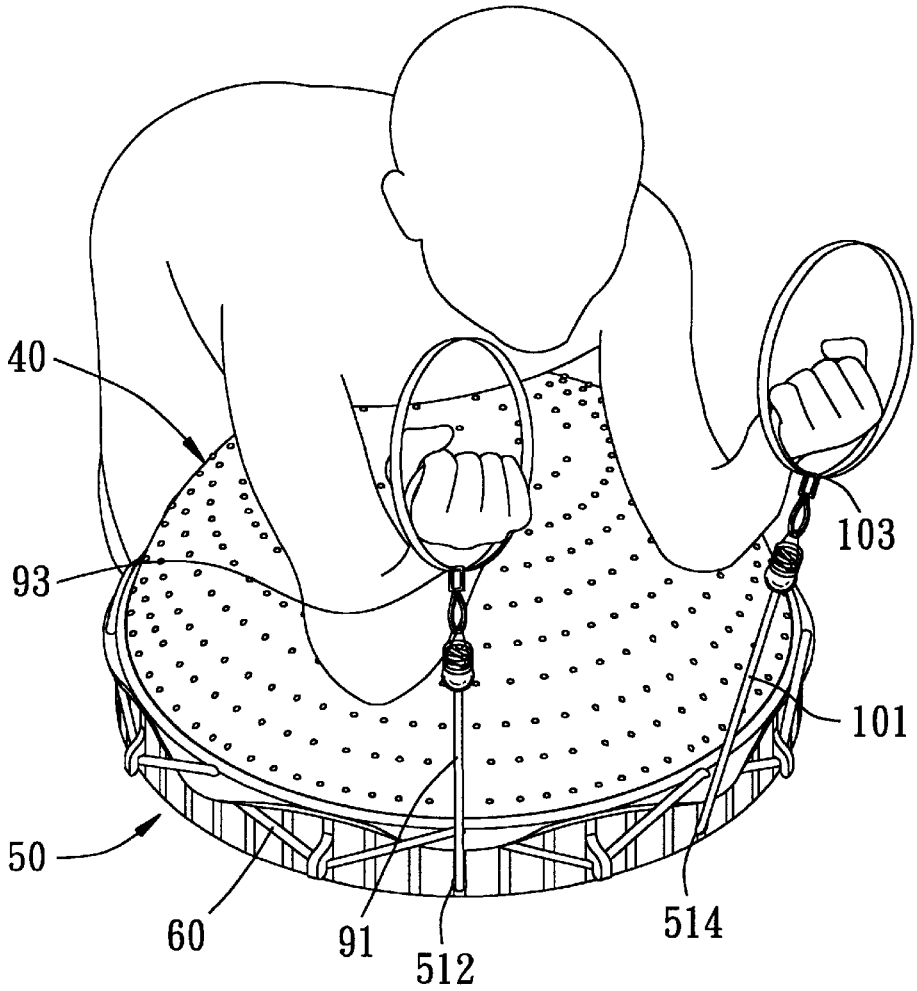
FIGS. 12 to 16 are schematic views respectively illustrating five exercising modes that can be performed using the embodiment shown in FIG. 11.
Figure 13:
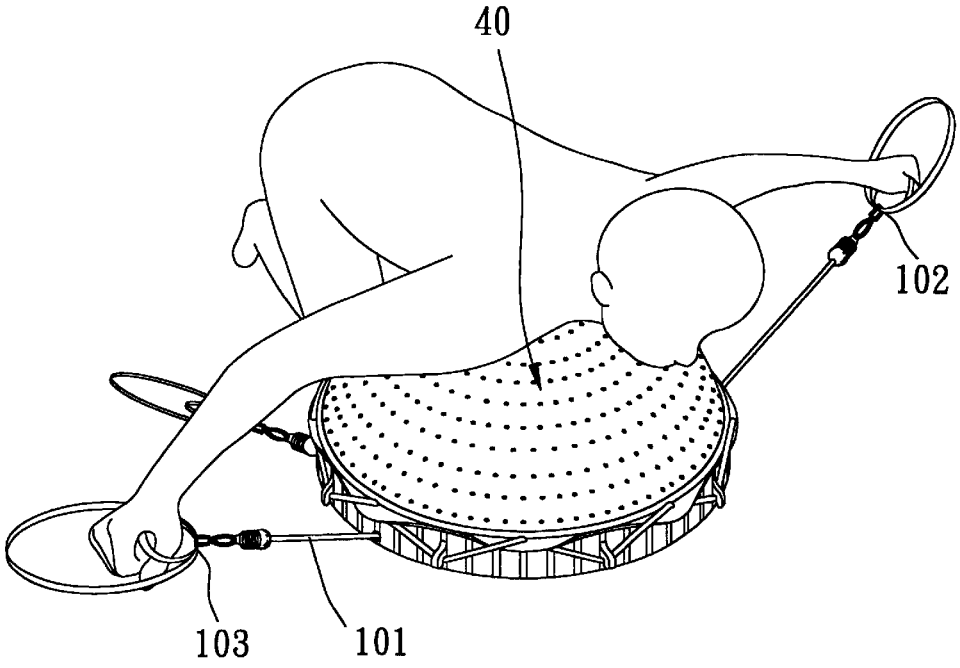
Figure 14:
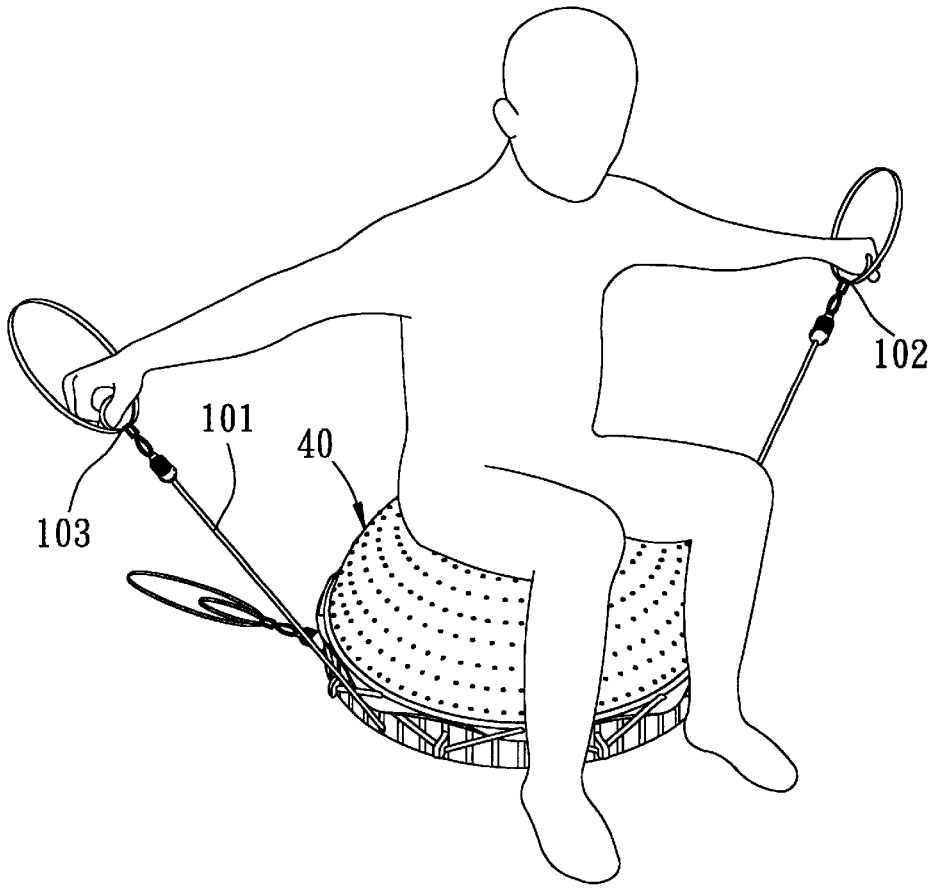
Figure 15:
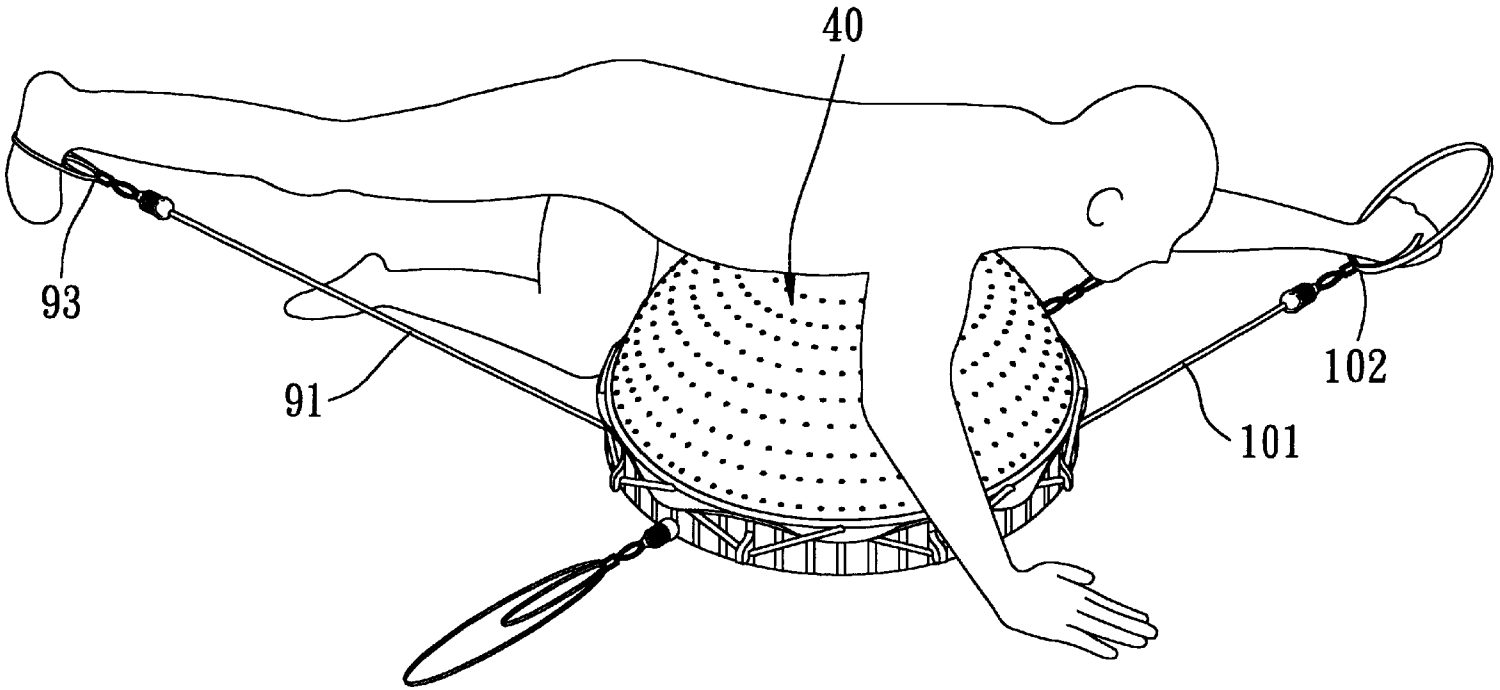
Figure 16:
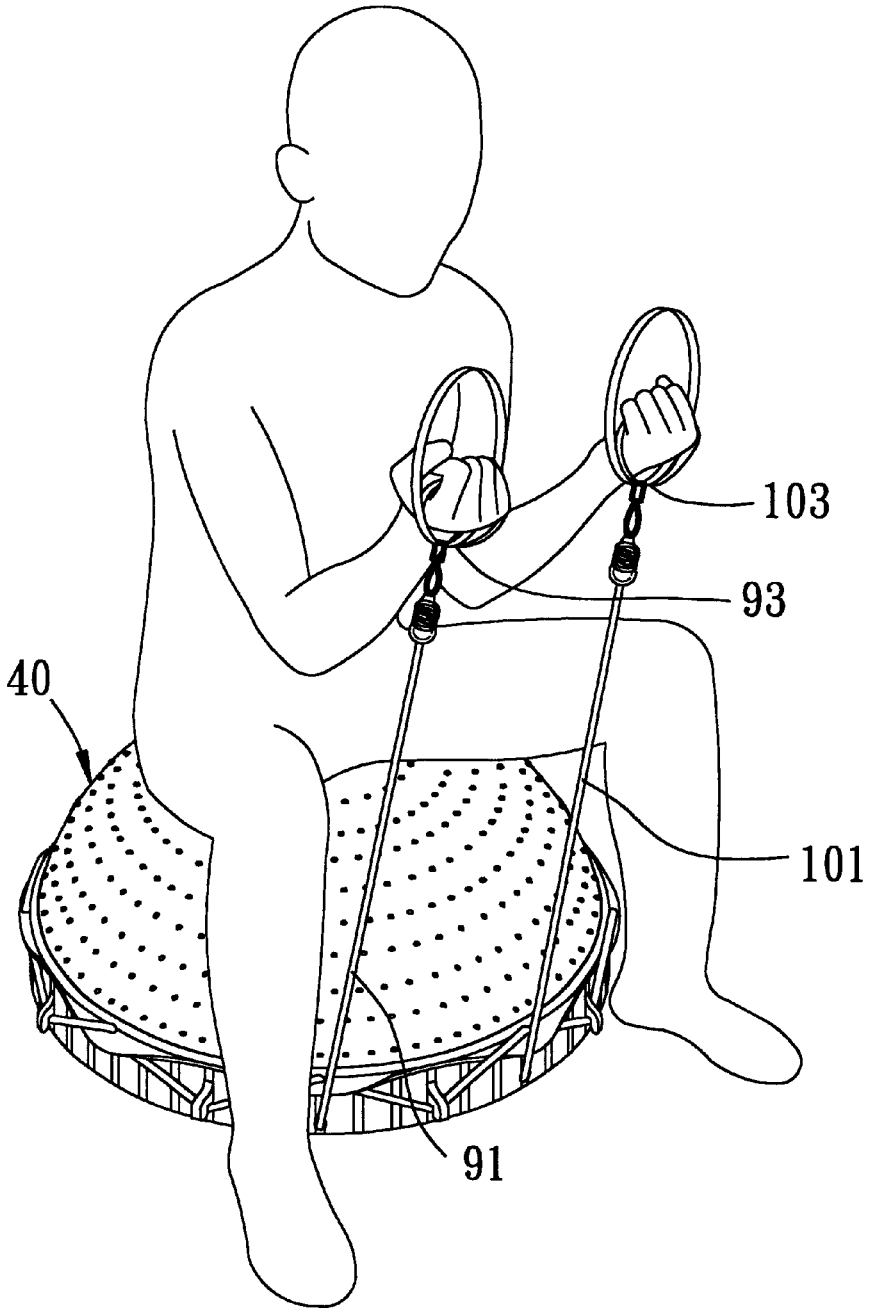

Furthermore, referring to FIG. 11, the compliant body-pressing exerciser assembly according to the present invention may additionally comprise a plurality of first and second pulleys 70, 80 which are mounted on the bottom wall of the seat frame 50 and which are angularly displaced from one another along the periphery 51 of the bottom wall in an alternating arrangement. A first elastic band 91 is trained on the first pulleys 70 and has two ends which are disposed radially and outwardly of the periphery 51 via through holes 511, 512 formed in the surrounding wall of the seat frame 50 and which are provided with two handgrips 92, 93. A second elastic band 101 is trained on the second pulleys 80 and has two ends which are disposed radially and outwardly of the periphery 51 via through holes 513, 514 formed in the surrounding wall of the seat frame 50 and which are provided with two handgrips 102, 103. Thus, as shown in FIGS. 11 to 16, when the exerciser 40 is retained on the seat frame 50 by means of the fastening cord 60, the user can lie or sit on the exerciser 40 to grasp the handgrips 92, 93, 102, 103 or to extend one foot in the handgrip 93 to perform different arm and leg stretching exercises.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A compliant body-pressing exerciser adapted to be detachably coupled to a seat frame, comprising:

a bowl-shaped lower member adapted to contact the ground and including an upper surrounding edge portion, and a lower rounded wall extending downwardly and convergently from said upper surrounding edge portion and terminating at a lowermost spot which is adapted to contact the ground when said exerciser is not in use; and a dome-shaped upper member adapted to compliantly press against a user's body, and including a lower surrounding edge portion which is disposed to engage said upper surrounding edge portion and which is associated with said upper surrounding edge portion to form a reference plane that is adapted to be disposed parallel to the ground, and an upper rounded wall which extends upwardly and convergently from said lower surrounding edge portion and which terminates at an apical spot, said apical spot cooperating with said lowermost spot to define a central line that is normal to and that intersects said reference plane at a central point, said bowl-shaped lower member and said dome-shaped upper member being configured such that a first height which is calculated from said apical spot to said central point is larger than a second height which is calculated from said lowermost spot to said central point, and such that a shortest one of first radial distances measured from said central point to said lower surrounding edge portion is not less than the first height.

2. The exerciser of claim 1, wherein the second height is not larger than ⅔ of a shortest one of second radial distances measured from said central point to said upper surrounding edge portion.

3. The exerciser of claim 1, wherein said dome-shaped upper member further includes a plurality of protrusions disposed on and extending outwardly from said upper rounded wall.

4. The exerciser of claim 1, wherein said lower rounded wall has a plurality of friction ribs formed thereon and adjacent to said lowermost spot.

5. The exerciser of claim 1, further comprising:

a plurality of lugs disposed on and extending radially and outwardly from one of said upper and lower surrounding edge portions, and angularly displaced from one another, each of said lugs having an eyelet disposed therein; and a fastening cord disposed to pass through said eyelets and adapted to be fastened to the seat frame.

6. A compliant body-pressing exerciser assembly comprising:

a seat frame having a bottom wall with a periphery, a surrounding wall extending upwardly from said periphery of said bottom wall to surround a middle line and to terminate at a surrounding upper peripheral edge portion, and an inner concave portion disposed to extend from said surrounding upper peripheral edge portion downwardly and toward the middle line so as to form an inner concave surface which confines an accommodation space; and a compliant body-pressing exercising member detachably retained in said accommodation space, and including:

a bowl-shaped lower member adapted to contact the ground, and including an upper surrounding edge portion which is disposed on said surrounding upper peripheral edge portion when said bowl-shaped lower member is retained in said accommodation space, and a lower rounded wall which extends downwardly and convergently from said upper surrounding edge portion and which terminates at a lowermost spot that is adapted to contact the ground when said exercising member is not in use, and a dome-shaped upper member adapted to compliantly press against a user's body, and including a lower surrounding edge portion which is disposed to engage said upper surrounding edge portion and which is associated with said upper surrounding edge portion to form a reference plane that is adapted to be disposed parallel to the ground, and an upper rounded wall which extends upwardly and convergently from said lower surrounding edge portion and which terminates at an apical spot, said apical spot cooperating with said lowermost spot to define a central line that is normal to and that intersects said reference plane at a central point, said bowl-shaped lower member and said dome-shaped upper member being configured such that a first height which is calculated from said apical spot to said central point is larger than a second height which is calculated from said lowermost spot to said central point, such that a shortest one of first radial distances measured from said central point to said lower surrounding edge portion is not less than the first height, and such that a shortest one of second radial distances measured from said central point to said upper surrounding edge portion is not less than the second height.

7. The assembly of claim 6, wherein said inner concave surface has a surrounding lower peripheral edge portion surrounding the middle line and disposed opposite to said surrounding upper peripheral edge portion to confine an opening for passage of said lowermost spot when said bowl-shaped lower member is retained in said accommodation space.

8. The assembly of claim 6, wherein said compliant body-pressing exercising member is made of a deformable material, said inner concave surface having a first curvature, said lower rounded wall having a second curvature less than the first curvature so as to be deformed to contact tightly said inner concave surface when said dome-shaped upper member is pressed.

9. The assembly of claim 6, wherein said exercising member further includes a plurality of lugs disposed on and extending radially and outwardly from one of said upper and lower surrounding edge portions, and angularly displaced from one another, each of said lugs having an eyelet disposed therein;

said seat frame further including a plurality of anchoring members disposed on said surrounding wall, and a fastening cord disposed to pass through said eyelets and fastened to said anchoring members.

10. The assembly of claim 6, wherein said seat frame further includes a plurality of support leg members disposed on and extending downwardly from said surrounding wall to support said seat frame on the ground.

11. The assembly of claim 6, further comprising:

a plurality of pulleys mounted on said bottom wall of said seat frame and angularly displaced from one another along said periphery, and an elastic band trained on said pulleys and having two ends which are disposed radially and outwardly of said periphery and which are provided respectively with two handgrips configured to be retained radially and outwardly of said periphery.

* * * * *